US005626458A

United States Patent [19]

Bettinelli et al.

[11] Patent Number: 5,626,458

[45] Date of Patent: May 6, 1997

[54] DEVICE FOR SIDEWISE ALIGNMENT OF FLAT WORKPIECES ON A TABLE

[75] Inventors: Fabio Bettinelli, Ecublens; Jean-Claude Rebeaud, Le Mont, both of Switzerland

[73] Assignee: Bobst SA, Lausanne, Switzerland

[21] Appl. No.: 393,365

[22] Filed: Feb. 23, 1995

[30] Foreign Application Priority Data

Feb. 24, 1994 [CH] Switzerland ..... 00550/94

[51] Int. Cl.[6] ..... B65G 25/00

[52] U.S. Cl. ..... 414/751; 271/249

[58] Field of Search ..... 414/749, 751, 414/14, 16, 17; 269/303; 271/249, 250

[56] References Cited

U.S. PATENT DOCUMENTS

| | | | |
|---|---|---|---|
| 1,988,791 | 1/1935 | Harrold . | |
| 2,553,758 | 5/1951 | Gegenheimer . | |
| 2,836,417 | 5/1958 | Gericke . | |
| 5,178,380 | 1/1993 | Grossmann | 271/250 |

FOREIGN PATENT DOCUMENTS

| | | | |
|---|---|---|---|
| 23135 | 1/1990 | Japan | 271/249 |
| 868222 | 5/1961 | United Kingdom . | |

*Primary Examiner*—Donald W. Underwood
*Attorney, Agent, or Firm*—Hill, Steadman & Simpson

[57] ABSTRACT

A device for sidewise alignment of a flat workpiece on a table includes a lower pull member for moving a flat workpiece toward a side stop and a pad for pressing the flat workpiece onto the pull member. The pad is fitted above the pull member on a bar that is lowered when the flat workpiece is applied against a front stop, and this pad is movable in translation along an axis parallel to the pull member. A spring urges the pad back to its initial position when the bar is raised to disengage the pad from the surface of the workpiece. The pull member and bar extend over the whole width of the table and the pull member is arranged in a groove made along an upper surface of a crossbar of the table, whereas the sides of the bar are held by ends of lever arms which are mounted for rotation on sides of the table frame.

11 Claims, 4 Drawing Sheets

DEVICE FOR SIDEWISE ALIGNMENT OF FLAT WORKPIECES ON A TABLE

BACKGROUND OF THE INVENTION

The present invention is directed to a device for sidewise or lateral alignment of flat workpieces on a feeding table of a die-cutting machine or platen press. On a feeding table, the flat workpiece is forwarded by means, such as a belt or a roller track, toward one or several front lays or stops and then carried by a second means, which is the object of the present invention, toward one or several positioning side marks or stops prior to the front edge of the workpiece being seized by a series of grippers fitted on a gripper bar of the platen press.

The device is used for the accurate sidewise alignment of flat workpieces that have already been printed with one or several printed patterns or motifs for the subsequent operation, which, possibly, may be either an additional printing in the platen press or a cutting and/or waste-ejecting process in the platen press. This subsequent operation must be achieved in a rigorous concordance with the previous printed patterns.

The devices for sidewise alignment used up to now include, first of all, a lower roll which is positively rotated as well as arranged to extend crosswise to the travelling direction of the workpiece close to the side stops, which are usually located on the left-hand side of the table when looking along the travelling direction of the workpiece, and which left-hand side is usually called the operator's side. These devices then include an upper roller which is fitted vertically to roll on an end of an arm which, at rest, is in the upper position. This arm is regularly lowered each time a flat workpiece reaches the front stops in such a way that the upper roller will press the flat workpiece against the driven lower roll, which action generates a corrective shift laterally to the side stops to position the workpiece.

A complementary device located at an inlet of the aligning device verifies the uniqueness of the workpiece which is taken into consideration. This device consists of a lower roll and an upper roll, which are situated on the same vertical plane oriented in the travelling direction of the workpiece and whose spacing is set so as to correspond to the thickness of only a single workpiece.

The proper alignment of the flat workpiece is verified owing to the motion of a spring plate arranged in front of the stop, which motion is established by means of a metallic flag that is part of the spring plate and that moves close to a magnetic detector.

Working satisfactorily with sheets of paper or cardboard with standard characteristics, these devices, however, reach their limits as soon as the basic weight becomes too heavy for the pulling power available. Moreover, such devices are not easily used for corrugated cardboard, because the pressure between the roller and the roll tends to flatten out the flutes. Finally, the application point for the pulling power is intangible, since it is defined by the dimensions of the device, which fact might be inconvenient dependent on the size of the flat workpiece to be processed and/or on the designs to be given a run.

These problems are actually partially overcome owing to another device which is arranged on the right-hand side of the table, i.e., the side opposite the operator, and includes an element which pushes crosswise on the side edge of the flat workpiece. However, this device works properly only if the workpiece is sufficiently rigid to offer resistance to such a rapid pushing over its whole width. Moreover, the mounting of the device, the special adjustment of the device and the subsequent dismantling of this expensive complementary device generate a long production down-time between each run.

SUMMARY OF THE INVENTION

The object of the present invention consists in putting forth a device for sidewise or lateral alignment, which, as has been the case up to now, is quick, efficient, reliable and, in addition, causes far less damage to the seized surfaces of the workpiece. Another object of the present invention consists in providing a device which might be converted into a device that pulls or pushes with the same component parts. This is possible in a position of action or engagement which is adjustable at will all along the width of the flat workpiece.

These objects are achieved by a device which includes a lower shifting means for moving the flat workpiece toward one or several side marks or stops and an upper means for pressing the flat workpiece onto the lower means. The device includes support means for mounting the upper means above the lower means on a bar that is lowered when the flat workpiece is applied against one or several front stops. The improvements are that the lower means includes a pull shaft or element which is moved toward the side stop when the bar is lowered and that the upper means includes pads which are mounted on the bar and are movable in translation along an axis parallel to the pull element so as to follow the motion of the flat workpiece and the pull element when the pad is pushed against the flat workpiece by the bar and includes elastic means for moving the pad back to its initial position when the .bar is raised.

The pulling power, if applied from the left-hand side, or the pushing power, if applied from the right-hand side, onto the flat workpiece is not achieved according to a simple line, as in the case with the previous devices, but according to a contact surface defined by the intersection of the lower surface of the pad and the corresponding upper surface of the pull element or shaft. In a typical execution, the pad has a lower rectangular surface of 2 cm by 3 cm and the pull shaft has a thickness of 2 cm.

Moreover, if a strong power or force becomes necessary without having to increase the pressure of the pad, it is possible to either select a longer pad or improve the coefficient of friction of the contact connection between the pull element, the flat workpiece and/or the flat workpiece and the pad.

In an advantageous embodiment, the lower side of the pad is made of a synthetic material with a rubber base having a high coefficient of friction.

According to an advantageous way of realization of the invention, the pad is inserted on an axle carried by the end of an almost horizontal balancing lever which pivots around its other end in a vertical plane. A downward stroke of the lever is limited by a retaining hook which acts on the balancing lever or on an axle, and the upward stroke is achieved contrary to the effect of a pullback means which acts vertically between an upper stop and either the balancing lever or the axle. The balancing lever may have the shape of an almost horizontal fork, the supporting axle for the pad passing through the ends of each of the two branches or legs of this fork or bifurcated lever.

Thereafter, by selecting or adjusting the pullback means, it is possible to modulate or change the pressure of the pad onto the flat workpiece. In a better way, the vertical position of the upper stop of the pullback means may be adjustable. This stop is especially part of the end of a vertically adjusting knob, whose outer threading is engaged in a tapered orifice of a piece that is part of the bar. Owing to this knob, it is particularly easy to be reached, and this adjustment of the pressure is extremely easy.

In an advantageous embodiment, the retaining hook is part of the lower end of a rod, whose upper threaded end is engaged in an adjusting nut which rests on a piece that is part of the bar. When turning this nut, it is also possible to adjust the initial position of the balancing lever and, hence, the position of the pad with regard to the bar. This adjustment of the initial position can additionally be turned to account during the adjustment of the pressure of the pad. When coordinating the lowering of the bar and the forwarding of the flat workpiece, this adjustment can also permit the equal obtainment of a device for verifying the uniqueness of the flat workpiece to be taken into account.

Usefully, a latch can be inserted at will between the adjusting nut and the piece that is part of the bar to enable keeping the balancing lever and pad in an upper position in which the pad always remains above the flat workpiece when the bar is lowered. Thus, a handy and easily realizable means is available for setting the alignment device out of operation or disengaging the device, if temporarily required.

In an advantageous embodiment, the elastic or biasing means which brings the pad back into its initial position when the bar is raised consists of a spring inserted on a second axle, which is carried by the end of the balancing lever, and which second axle extends close and parallel to the first supporting axle of the pad so that the spring which acts between a leg of the balancing lever and a ring of the pad, which ring is telescopically received on the second axle. This arrangement reduces the cumbersomeness of the upper means that presses onto the flat workpiece to such an extent that it can be incorporated in a compact block fitted on the bar.

Usefully, the upper means that presses onto the flat workpiece are contained in a block, whose structure has a symmetry as to the vertical median plane parallel to the travelling axis of the flat workpiece. This block is inserted on the bar, where it is locked into position by fastening elements, such as a threaded axle crossing the block throughout a tapped orifice and the outer end being provided with a handle as the inner end rests on the bar. This conceptional symmetry of the block that contains the balancing lever with the pad and its spring, the pressure adjusting pullback means and the hook-carrying rod allows for the elements to be arranged in it either for the alignment of the operator's side or for alignment on the side opposite the operator. This operation is thus achieved without requiring any additional pieces.

In an advantageous embodiment, the pull shaft or member and the bar extend over the whole width of the table, and the pull shaft or element is arranged in a groove made along an upper surface of a crossbar of the table, whereas an end of the upper bar is held at an upper end of a pivot arm, whose lower end is mounted for rotation on the side of a table frame through an intermediate support plate, if required.

This arrangement enables the positioning of the block that contains the upper pressing means at any point on the front edge of the flat workpiece in order to take into account the geometry and/or characteristics of the designs or motifs carried on the workpiece. A positioning of the block close to the left-hand side of the table generates rather a pull on the workpiece, whereas positioning of the block close to the right-hand side of the table will create a pushing force on the flat workpiece. In other words, the same lower and upper means, each set into action by their single control and actuating means, permits the realization of either a pulling or a pushing operation. This arrangement allows for a substantial gain by the fact that the previously used additional device is no longer required. Finally, by arranging a pair of blocks, a coordinate pull and push can be achieved simultaneously, if required.

Usefully, the control and actuating means of the bar, which lowers the upper bar when the flat workpiece has reached a front stop, may include a vertically rotatable scanning roller or follower fitted on one or the other side, either on the lateral arms of the bar or an extension of the arm beyond its rotational point. This roller rests on a vertical cam, which extends parallel to the arms and is driven by means that forward the flat workpiece onto the table, the pullback means acting upwardly, respectively, either on an extension of the arm beyond its rotation point or a lateral arm to urge the follower onto the cam surface.

Usefully, the arms of the bar are arranged on the sides of the table frame or on the intermediate support plates movable in rotation as Well as in translation parallelly to the bar, adjusting means including a screw that is engaged in the frame or in one of the plates and allowing the adjustment of the lateral position of the bar with respect to the table. After a rough positioning of the block along the bar, these adjusting means are arranged at the end of the bar and, preferably, on the operator's side allow for an easy realization of the ultimate accurate positioning of the block.

Usefully, the control and actuating means of the pull member or shaft, which moves the shaft toward the side mark when the bar is lowered, includes a rotary scanning roller mounted at one of the ends of the pull member and, if required, through a fastening block extended by a rod. The pull member or fastening block or the rod is pushed by a pullback means in order to maintain the roller against a cam, whose action is effective along the axis of the pull member.

Such control devices of a simple conception have proved to be reliable and efficient in practice. Moreover, a simple half-turn of the cam of the pull element on its shaft is sufficient for changing the movement of the pull element toward the right-hand to be toward the left-hand side of the table at the moment the bar is lowered.

Other advantages and features of the invention will be readily apparent from the following description of the preferred embodiments, the drawings and claims.

DESCRIPTION OF THE PREFERRED EMBODIMENT

Figure 1:
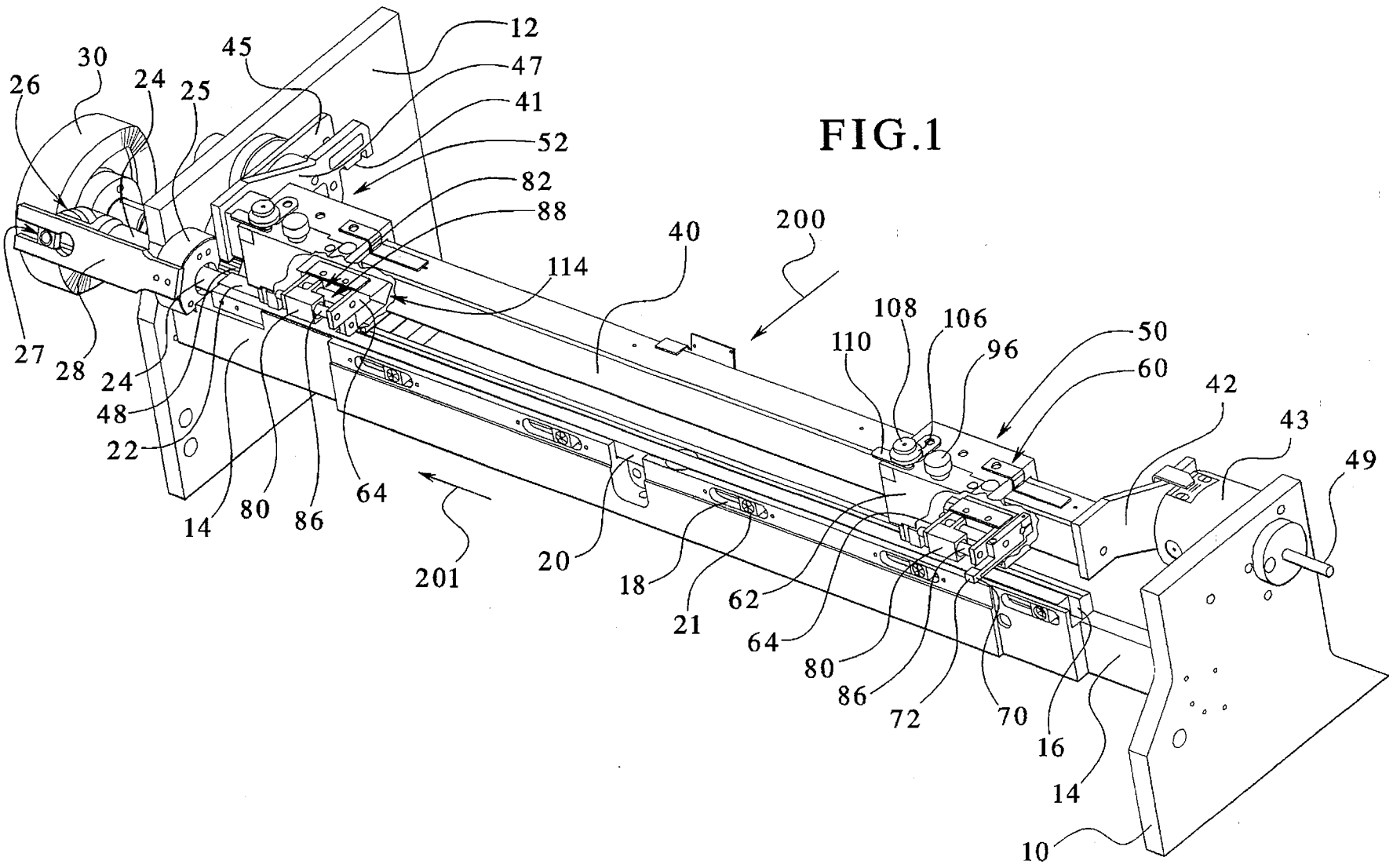
FIG. 1 is a perspective view of the device in accordance with the present invention as seen from downstream on the operator's side.
Figure 2:
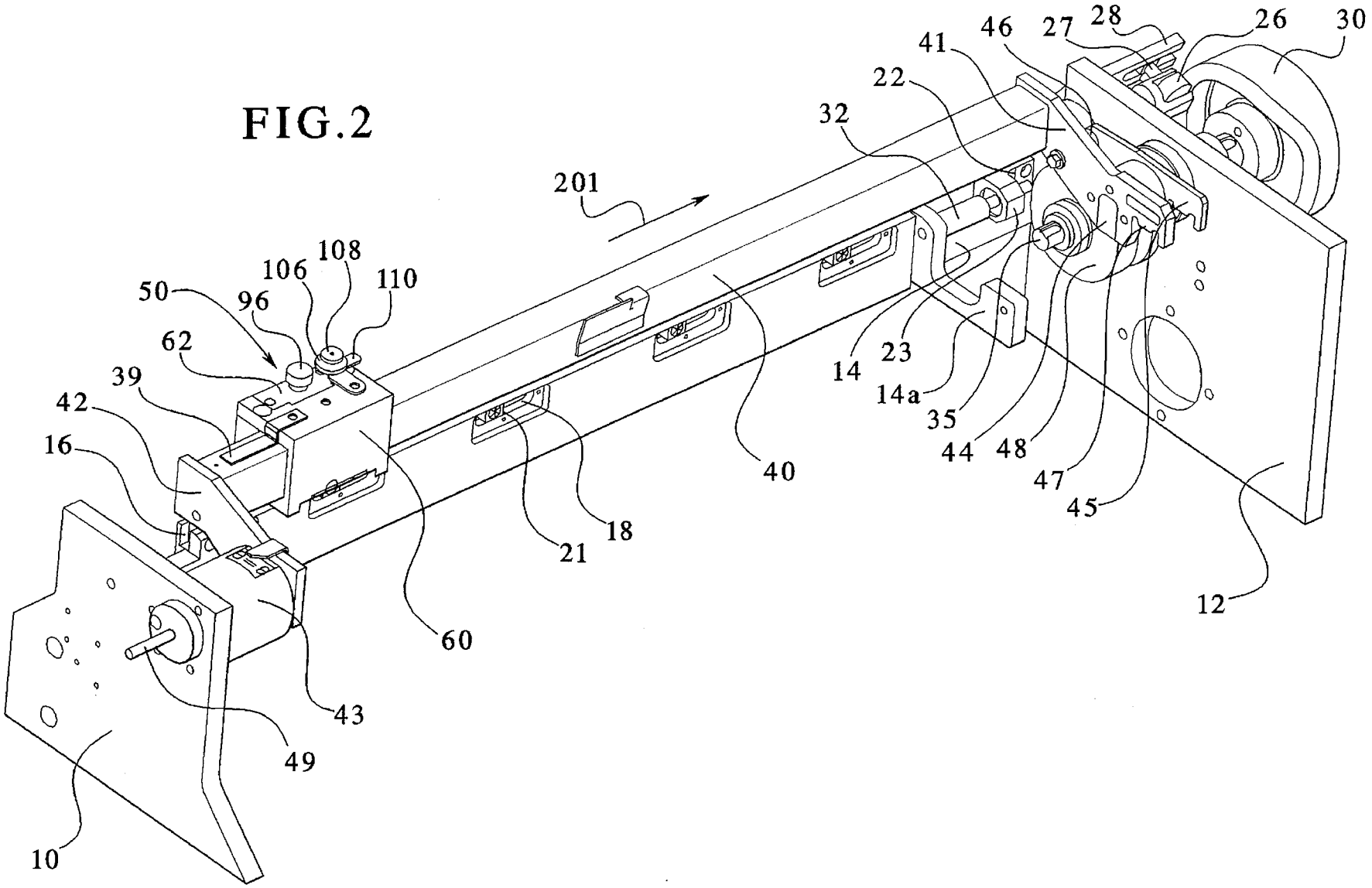
FIG. 2 is a perspective view of the device of FIG. 1 as seen from upstream on the operator's side.
Figure 4:
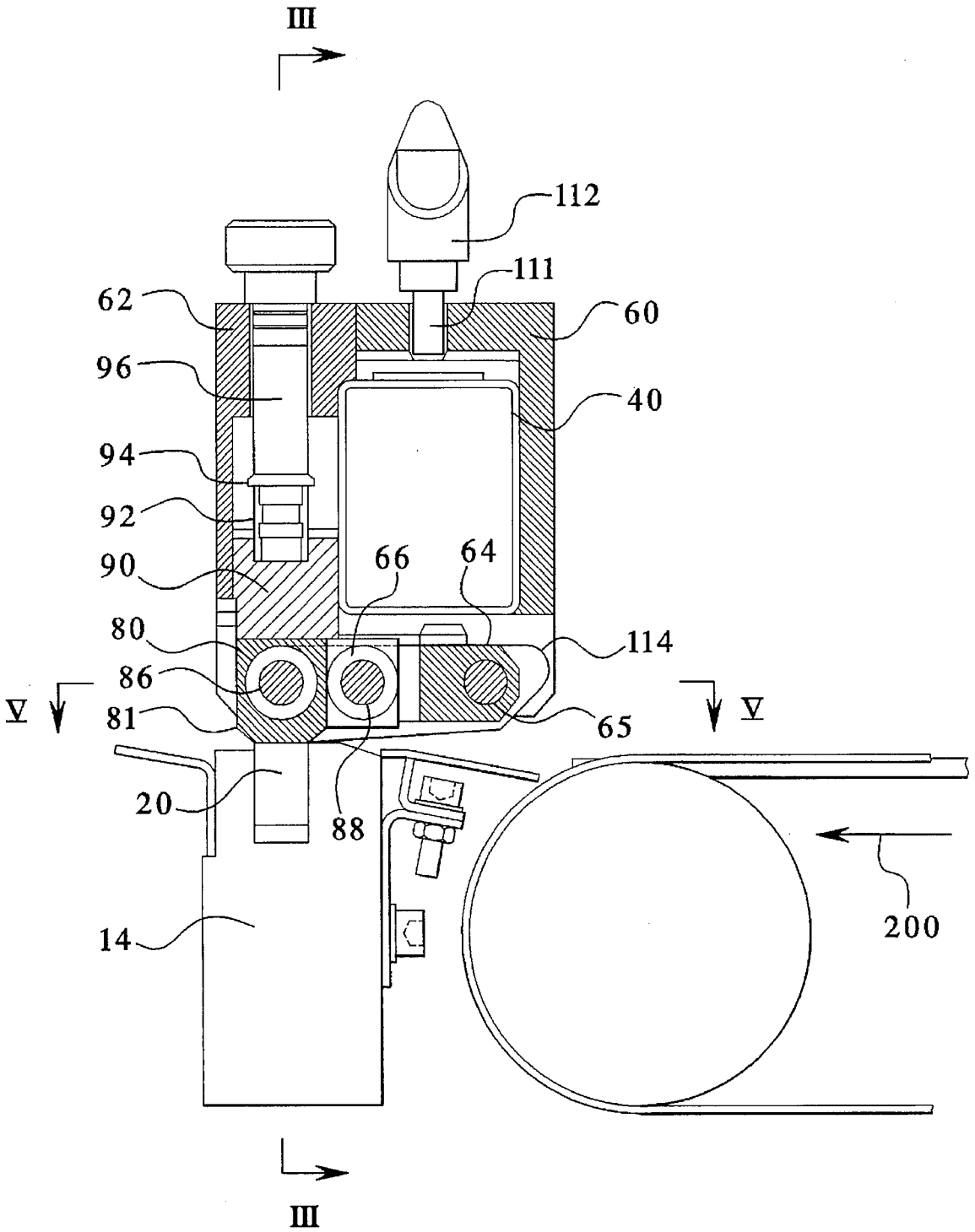
FIG. 4 is a cross sectional view of the block of FIG. 3 taken along the lines IV—IV of FIG. 3.

The principles of the present invention are particularly useful in an apparatus or device, which is illustrated in FIGS. 1 and 2, for the sidewise alignment of a workpiece travelling in the direction of the arrow 200 of FIG. 1 or FIG. 4. The device includes a frame formed by two sidewise support plates 10 and 12, which are interconnected by a crossbar 14, and this frame is fitted or dismantled at will outside of the downstream part of a feeding station within a machine that processes flat workpieces.

The device includes, on its lower part, a pull shaft, member or element 20 which is mounted to slide in a direction indicated by arrow 201, which extend crosswise to the arrow 200, in a groove or slot 16 in an upper surface of the crossbar 14. A plurality of guides 21 are attached to the pull element 20, for instance by means of screws, and these guides are movable inside a lengthwise groove or slot 18 made in the crossbar 14 on either side of the groove 16. The guides 21 prevent an erratic movement of the pull element in a vertical direction, which might make it come out of the groove.

The end of the pull element 20 situated on the side opposite the operator, i.e., on the left-hand side of FIG. 1 and the right-hand side of FIG. 2, is connected by means of a fastening block 22 to an extension rod 24, which extends through the supporting plate 12 through a bearing 25 that is part of the plate 12. As best illustrated in FIG. 2, this block 22 is completed with a stop 23 against which a pushing spring 32 acts, whose other end rests on a lateral protuberance 14*a* of the crossbar 14. Thus arranged, the spring 32 pushes, at rest, the pull element 20, the block 22 and the rod 24 toward the outside on the side opposite the operator and urges the element in the direction of the arrow 201 of FIG. 2.

The end of the rod 24 is bifurcated and shaped as a fork in order to hold a scanning roller or cam follower 26, which rides on a crosswise cam, whose thickness is variable in such a way that its action will be executed in a lengthwise direction of the pull element 20. Preferably, this scanning roller or cam follower 26 is guided in its motion by a guide 27 (best illustrated in FIG. 1) which moves inside a guiding fork 28, which is part of the support plate 12, for instance, by being mounted onto the bearing 25. If required, the cam 30 could also have the shape of an oval disc which is mounted for rotation parallel to the guide 28. As illustrated, the cam 30 will impart to the pull element 20 a reciprocating motion and the cam surface is designed to have two reciprocations for each complete rotation of the cam 30.

In its upper part, the device includes a first bar 40 which is held on the end opposite the side of the operator by an arm 41 and by an arm 42 on the side adjacent the operator or plate 10. The lower end of the arm 41, as best illustrated in FIG. 2, is provided with a U-shaped notch which receives a drive axle 44 which has two opposed flat surfaces which are in correspondence with the size of the notch to form a spline-type connection. This connection allows a transmission of rotational torque to the bar 41 while also allowing, at the same time, a movement of the arm 41 and the bar 40 along an axis extending parallel to the direction of the arrow 201 and also the axis of the pull element 20.

On the same axle 44, a drive arm 45 is fitted to extend parallel to the arm 41, and these two arms are connected at the other end by an axle for a scanning roller 46. The scanning roller 46 acts on a slightly oval bar hoisting cam 48 (best illustrated in FIG. 2). This cam 48 is arranged vertically and parallel to the arms 41 and 45, and the cam is driven simultaneously with the cam 30 of the pull member 20 by a general drive power point 35 of the station of the machine. This drive is, thus, also coordinated with the non-represented means for forwarding the flat workpieces.

The arms 41 and 45 have an extension 47 (see FIGS. 1 and 2) which extends on the opposite side of the axle or shaft 44 and receives the upward push of a non-illustrated lower vertically extending spring, whose lower end rests on a stop that is part of the plate 12. In other words, the action of the non-represented spring tends to tilt the arms 41 and 42 in a counter-clockwise direction, as illustrated in FIGS. 1 and 2, whereas the action of the cam 48 onto the scanning roller 46 tends to rotate the arms 41 and 42 in a clockwise direction during rotation of the cam to raise the bar 40 at regular intervals during the rotation of the cam.

On the operator's side (adjacent the plate 10), the lower or other end of the arm 42 is mounted in a bearing 43, whose outer rim may be moved forward or backward into a case when an adjusting screw 49 is actuated. Thus, by moving this bearing and, hence, the crosswise position of the arm 42, the lateral position of the bar 40 can be adjusted very precisely, with the U-shaped notch of the lower end of the arm 41 being moved to the same extent with regard to the driving axle 44.

The bar 40 has mounted a pulling block 50, which is positioned adjacent the operator's side, and/or a pushing block 52, which is on the side opposite the operator's side. In the way of illustrating these particular blocks, they are built for side alignment on the operator's side, the sole difference between the blocks 50 and 52 resides in the mounting of the side stop 70 for the flat workpiece on the side of the block 50. This side mark or stop is completely on one side by a spring plate 72 which, when touched by a flat workpiece, moves a flag close to a magnetic proximity detector 74 (illustrated in FIG. 5) to create a control signal. For a description of the block 50, reference is made to FIGS. 3, 4 and 5.

The block 50 has two housing parts, including an upstream part 60 and a downstream part 62 (see FIG. 4). On an upstream lower edge, the part 60 has a cavity 66 with an axle 65 on which a balancing lever 64 having the shape of a fork is oriented to extend downstream and is mounted for rotation in a vertical plane. Two parallel axles 86 and 88 are mounted between the two branches or legs of the fork making up the lever 64.

Figure 3:
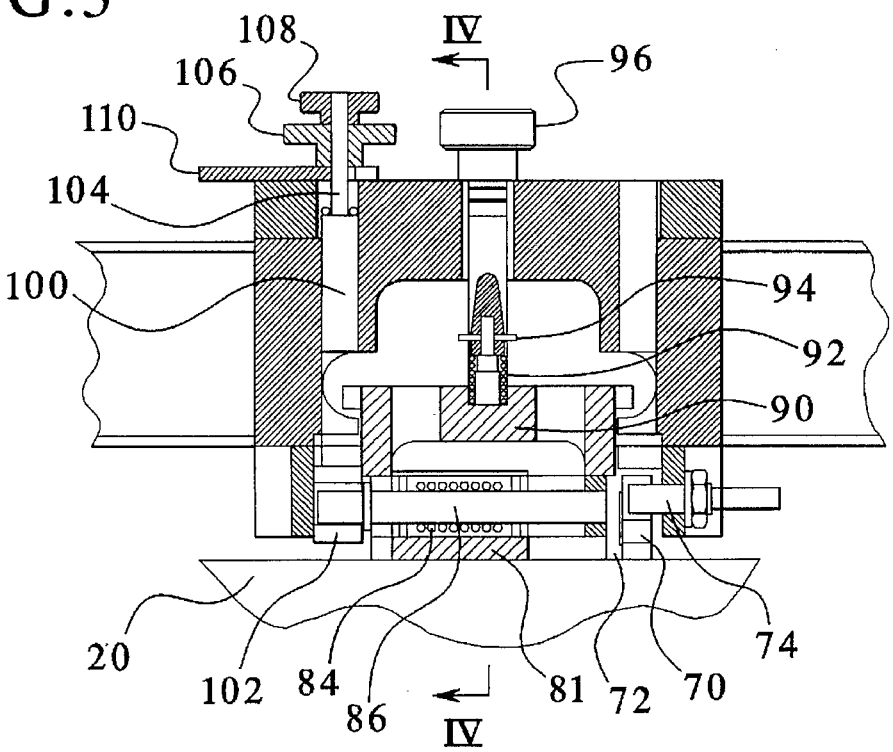
FIG. 3 is a cross sectional view of a block containing an upper pressing means taken along the line III—III of FIG. 4.
Figure 5:
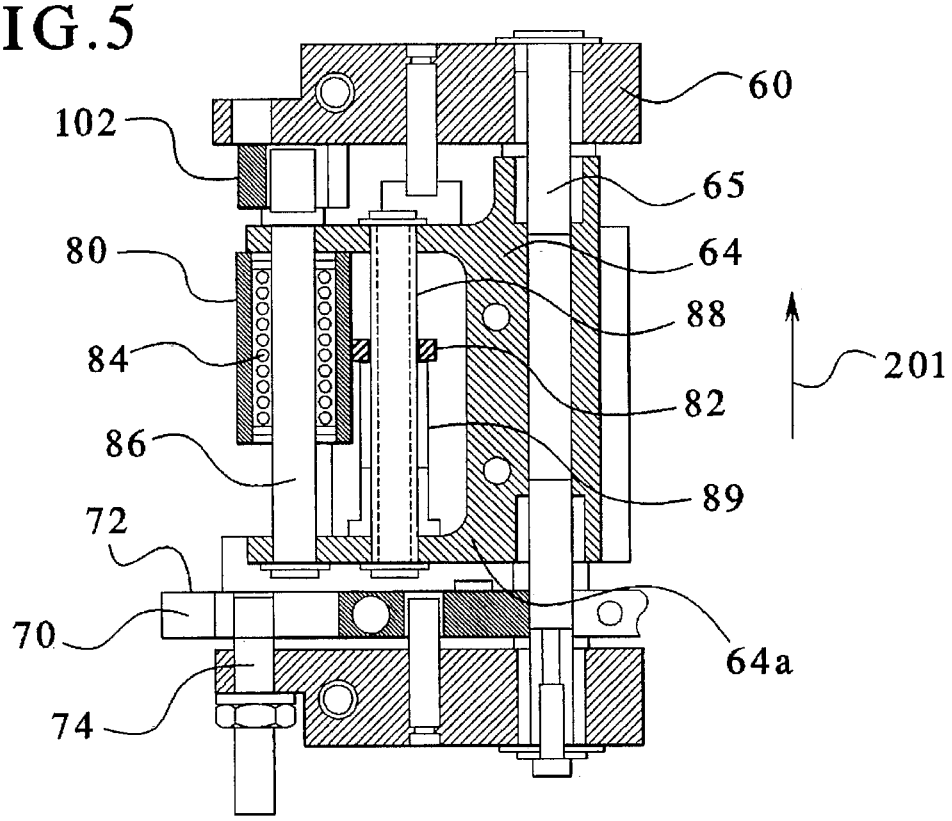
FIG. 5 is a cross sectional view of the block taken along the lines V—V of FIG. 4.

A pad 80 is inserted over the first outer axle 86 and is movable in translation, which action becomes easy owing to a ball track 84 (see FIGS. 3 and 5). This pad 80 has a lower surface or layer 81 and a lateral extension shaped as a ring 82, which telescopically receives the second inner axle 88. This ring 82 makes up a stop for a spring 89, which is telescopically received on the axle 88 and rests on a branch or leg 64*a* of the lever 64. Any motion of the pad 80 toward the operator's side along the axle 86 is, thus, achieved against the force of the compression spring 89.

As best illustrated in FIG. 3, a strap or member 90, which is pushed downward by a spring 92, presses on the end of each of the legs or branches that make up the fork of the lever 64. The upper end of the spring 92 rests on an adjustable stop 94 that is part of the lower end of an adjusting serrated knob 96, whose outer threads are engaged in a threaded orifice made in an upper wall of the housing part 62. Thus, the stop 94 can more or less be raised and, hence, the biasing force of the spring 92 can be adjusted by rotation of the knob 96.

In addition, an extension or end of the axle 86 is seized or engaged in a hook 102 that is part of a lower end of a retaining rod 100, whose upper threaded end 104 is engaged in an adjustment nut 106. The lower face of this nut rests normally on an upper surface of the housing 62. Thus, the retaining hook 102 can more or less be raised by simple rotation of this nut, which operation defines the initial height of the axle 86 and, hence, the pad 80. A counter-nut 108 allows a locking of the particular setting.

If required, the adjustment nut 106 can be temporarily raised in order to fit a latch or key 110 on top of the upper side of the housing part 62. The position of the retaining hook 102 is, thus, voluntarily higher than necessary, due to the thickness of this latch or key 110.

As best shown in FIG. 4, the housing part 60 above the position of the lever 64 has a crosswise passage which allows for the block 50 to be mounted telescopically on the bar 40. A threaded rod 111 turned by means of a handle 112 allows for locking the position of the parts by tightening the threaded rod so that an end presses on the bar 40.

A deflecting plate 114 (FIG. 4) protects the lever 64 from being struck by the front edge of flat workpieces that normally pass therebeneath.

As shown in FIG. 3, the part 62 is rigorously symmetric with regard to its median plane, which is shown by the section line IV—IV. In this way, the position of the retaining rod 100, as well as the stop 70 with its sensors 72 and 74, can, at any time, be inverted on the other side, and when the balancing lever has been turned, the spring 89 can be fitted on the other side of the ring 82 in such a way that the motion of the pad 80 in the direction of the arrow 201 in FIG. 5 will be opposed, whereas the illustrated arrangement has the spring acting to move the pad in the direction of the arrow 201.

The device will now be described in the following way. One of the blocks, either the pulling block 50 or the pushing block 52, is, if required, set out of operation by inserting the latch or key 110 under the adjusting nut 106. The lateral position of the active block is then roughly set by separating or releasing the block from the bar 40 by actuating the handle 112. The block can then be moved along a graduated ruler 39 (see FIG. 2) to the desired position. The block is then tightened on the bar again by screwing the end of the shaft 111 onto the bar 40. Then, the adjusting screw 49, which finely moves the assembly of the bar 40 and concerned block is actuated, the required accurate positioning of the pad 80 is obtained.

The connection of the drive power point 35 is achieved in such a way that the cam 48 only lowers the bar 40 when the flat workpiece has already been aligned on non-represented front lays or stops. The lowering of the bar 40 and also the block 50 will cause the pad 80 to apply its lower side or layer 81 on the flat workpiece and to press it onto the pull element or shaft 20 with a force which is dependent on the setting of the stop 94 of the vertical spring 92. This flat workpiece is, thus, no longer pressed on a line but according to the intersection surfaces of the lower side 81 of the pad 80 and of the corresponding upper Surface of the pull element 20. This surface has a width of 2 cm and a length of 3 cm, for example, which fact causes the application of the force to be regularly distributed into a pressure not susceptible to damaging the lower and upper contact surfaces of the flat workpiece.

The cam 30, which is synchronized with the cam 48, transmits a translation motion to the pull element or shaft 20, which moves the flat workpiece toward the side stop 70. Thus, the flat workpiece is dragged along the pad 80, which moves contrary to or against the compression of the spring 89. When the flat workpiece is stopped by the side stop 70, the pull element 20 ends its stroke and slides a little with regard to the flat workpiece. The upper smooth surface of this pull element 20 should not damage, in any way, the contact surface. Simultaneously, the flag of the spring plate 72 is moved close to the proximity detector 74 which provides a signal to confirm that the operation has been fully executed.

The flat workpiece thus aligned with its front edge may be seized by the grippers arranged along a gripper bar (not illustrated). The cam 48 has moved to allow the raising of the bar 40, hence to the block 50. When the pad 80 is not engaged with the flat workpiece anymore, the spring 89 shifts the pad back to the initial position, such as illustrated in FIG. 5, and, thus, makes it ready for the next operation.

If the alignment operation is not to occur in the direction of the operator's side but in the opposite direction, the block 50 is dismantled in order to laterally invert the inner components, i.e., the side mark or stop in the travelling direction of the pad. In addition, the cam 30 is offset by 90° or 180° in such a way that the pull element 20 will move in the other direction when the bar 40 is lowered.

As has been gathered from the reading of this description, the device according to the present invention provides an opportunity of lateral aligning toward a first side either by pulling or pushing or making the same operation in the opposite direction with the same elements. Moreover, the cam 48 can be adapted so that the bar is quickly lowered into a first position in which the lower edge of the pre-set pad 80 remains temporarily at a height just sufficient for letting one flat workpiece travel before it is being pressed onto the pull element.

An appreciable feature is that by adjusting the pressure of the pad, as well as the characteristics and the dimensions of the contact surface of the pad, it is possible to cover a large range of lateral pulling power or forces at the same time with respect to a maximum pressure not to be exceeded so that the surfaces of the flat workpiece are not damaged.

Although various minor modifications may be suggested by those versed in the art, it should be understood that we wish to embody within the scope of the patent granted hereon all such modifications as reasonably and properly come within the scope of our contribution to the art.

We claim:

1. In a device for lateral alignment of a flat workpiece on a table, said device including lower means for carrying the flat workpiece toward a side stop, upper means for pressing the flat workpiece onto the lower means, and support means for mounting the upper means above the lower means including a bar supporting the upper means and means for lowering the bar, the improvements comprising the lower means including a pull member movable toward the side stop when the bar is lowered; the upper means including a pad, pad mounting means for mounting the pad for movement in translation along an axis parallel to the pull member so as to follow the motion of the flat workpiece and the pull member when said pad is pushed against the flat workpiece by the bar, and elastic means for acting on the pad to return the pad to an initial position when the bar is in a raised position to disengage the pad from the workpiece; and control and actuator means for moving the bar and pull member.

2. In a device according to claim 1, wherein the pad mounting means includes a housing mounted on said bar, a balancing lever having one end mounted for pivotable movement in said housing to pivot around a substantially horizontal axis, a free end of said balancing lever having an axle with the pad mounted for movement therealong, biasing means for acting on the balancing lever to pivot the lever to urge the pad toward the workpiece, and a retaining hook for limiting the amount of movement of the pad toward the workpiece by engaging the axle.

3. In a device according to claim 2, wherein the biasing means includes a threaded shaft having a knob at one end being threaded in a threaded bore of the housing, said threaded shaft having one end providing an upper stop for the biasing means so that the amount of the force of the biasing means can be adjusted.

4. In a device according to claim 2, wherein the retaining hook is mounted in said housing on an end of a rod whose upper threaded end is engaged in an adjusting nut which rests on an upper surface of the housing.

5. In a device according to claim 4, wherein a latch can be inserted between the adjusting nut and the upper surface of the housing to raise the balancing lever and pad to an upper position with the pad disengaged from any flat workpiece passing therebelow.

6. In a device according to claim 2, wherein the elastic means consists of a spring telescopically received on a second axle carried adjacent the end of the balancing lever, and extending substantially parallel to the first-mentioned axle supporting the pad, said spring acting between a stop forming a ring received on the second axle and a surface of the balancing lever.

7. In a device according to claim 1, wherein the upper means includes a block having a structure with symmetry around a vertical plane extending parallel to a travelling axis of the flat workpiece, said block having a passage for receiving the bar for movement along said bar, said block having means for locking the block in a fixed position on said bar including a threaded member received in the block having one end engaging the bar and the other end provided with a handle.

8. In a device according to claim 1, wherein the pull member and the bar extend over the whole width of the table, said pull member being arranged in a groove made along an upper surface of a crossbar of the table, said bar of the support means being mounted at each end on pivot arms mounted for rotation on a table frame through intermediate support plates.

9. In a device according to claim 8, wherein the control and actuating means for the bar include a vertically rotatable scanning roller mounted on one of said lateral arms of the bar, said roller resting on a cam surface of a vertical cam which extends parallel to the arm and is rotated by means that forward the flat workpiece onto the table, pullback means acting between one of the arms and said frame to cause rotation of the pivot arms in a direction to hold the scanning roller on the cam surface.

10. In a device according to claim 9, wherein the pivot arms of the bar are arranged on sides of the table frame and are movable in translation parallel to said bar, adjustment means including a threaded member for engaging the frame and allowing adjustment of the lateral position of the bar with regard to the table.

11. In a device according to claim 8, wherein the control and actuating means for the pull member which moves laterally toward the side stop when the bar is lowered include a rotary scanning roller mounted at one end of the pull member and engaged on a cam surface causing oscillation of said pull member, and means for biasing the scanning roller onto said cam surface.

* * * * *